United States Patent [19]

Carlson

[11] Patent Number: 4,955,277

[45] Date of Patent: Sep. 11, 1990

[54] DRUM PEDAL

[76] Inventor: Karl R. Carlson, 412 - 5th Ave., Fairbanks, Ak. 99701

[21] Appl. No.: 414,179

[22] Filed: Sep. 28, 1989

Related U.S. Application Data

[63] Continuation-in-part of Ser. No. 148,034, Jan. 25, 1988, Pat. No. 4,890,532.

[51] Int. Cl.[5] ..... G10D 13/02
[52] U.S. Cl. ..... 84/422.1
[58] Field of Search ..... 84/422.1, 422.2

[56] References Cited

U.S. PATENT DOCUMENTS

| | | | |
|---|---|---|---|
| 1,319,994 | 10/1919 | Dorn | 84/422 R |
| 3,316,792 | 5/1967 | Ippolito | 84/422 R |
| 3,797,356 | 3/1974 | Duffy et al. | 84/422 R |
| 4,691,613 | 9/1987 | Jacobson | 84/422 R |
| 4,819,536 | 4/1989 | Lombardi | 84/422.1 |
| 4,890,532 | 1/1990 | Carlson | 84/422.1 |

FOREIGN PATENT DOCUMENTS

| | | | |
|---|---|---|---|
| 1004026 | 3/1957 | Fed. Rep. of Germany | 84/422.1 |
| 3205306 | 8/1983 | Fed. Rep. of Germany | 84/422.1 |
| 2146162 | 4/1985 | United Kingdom | 84/422.1 |
| 2172137 | 9/1986 | United Kingdom | 84/422.1 |

*Primary Examiner*—Lawrence R. Franklin
*Attorney, Agent, or Firm*—Patrick Michael Dwyer

[57] ABSTRACT

An improved drum pedal for use with an acoustic or electronic bass drum has sprocket wheel 78 mounted for rotation on the toe end of a foot pedal 16. A rotational torque applied to a sprocket 72 attached to a crossarm 22 and in turn to a mallet head 28 causes mallet head 28 to swing through an arc 3 toward the drum head. Sprocket 72 and sprocket wheel 78 are connected by chain 76 in a compound pulley system wherein chain 76 is attached at one end to sprocket 72 and is wrapped around and under sprocket wheel 78 to be fixed at its other end at mounting bar 80, so that a downward motion of foot pedal 16 and sprocket wheel 78 through arc 2 moves sprocket 72 and mallet head 28 through arc 3, which motion is twice the magnitude in distance and velocity as that of sprocket wheel 78.

9 Claims, 3 Drawing Sheets

DRUM PEDAL

This is a Continuation-in-Part of U.S. patent application Ser. No. 07/148,034, filed Jan. 25, 1988, U.S. Pat. No. 4,890,532.

TECHNICAL FIELD

The present invention relates generally to foot activated musical drum impacting devices and more particularly to a device used in conjunction with a musical drum which translates foot motion into motion of a mallet to impact the surface of a drum.

BACKGROUND OF THE INVENTION

Standard foot activated musical drum pedal devices are known in the prior art to include generally a base, foot pedal, and mallet head mechanically linked together to translate foot motion into a drum beating activity. These devices are generally used in conjunction with a large musical bass drum. The pedal device generally is fixed to a bottom portion of the bass drum rim. The musician generally sits back and above the pedal device. The device is activated by the musician depressing the forward end of the foot pedal which causes the mallet head to impact a surface of the bass drum.

The velocity of the mallet head as it impacts the drum head defines, in part, the quality of the music produced by the drum. In general, the greater the velocity of the mallet as it strikes the drum head, the greater the volume and the sharper the attack of the resulting drum note.

Known drum pedals directly link the toe end of a foot pedal to a crossarm, supported by a pair of uprights, generally above the toe end of a foot pedal. The linkage may be a flexible member such as nylon cordage that is attached to the rear portion of a curved lever arm with upwardly facing pulley grooves and then wrapped through the pulley grooves over the forward end of the lever arm, and then downward to terminate and attach directly at the toe end of the foot pedal. More expensive models replace the lever arm with a sprocket wheel and employ a chain drive as the flexible member. The chain is attached to a rearward portion of the sprocket wheel, wrapped over the top of the wheel and then downward to terminate and attach directly to the toe end of the foot pedal. See for instance, U.S. Pat. No. 3,797,356 to Duffy et al.

These known drum pedals present a compound leverage system whereby the downward motion of a toe end of the drum pedal is converted into a generally arcuate forward swing of the mallet head into an impact collision with the drum head. The leverage system in these known device converts a downward arcuate velocity of the toe end of the foot pedal into a forward arcuate velocity of the mallet head, generally in a ratio greater than 1:1. That is, the mallet head actually strikes the drum head at a velocity greater than the greatest velocity of the toe end of the pedal as it travels downwardly under the drummer's foot. Known devices provide means to some extent to adjust this ratio, usually by shortening or lengthening the effective length of the mallet handle.

For either type of pedal, the termination and direct attachment of the flexible member at the toe end of the foot pedal however prevents obtaining further mechanical advantage at the foot pedal whereby the downward velocity of the foot pedal can be more greatly amplified to cause the mallet head to strike the drum surface with even greater velocity.

DISCLOSURE OF THE INVENTION

Accordingly, it is a general object of the invention to provide an improved drum pedal having means to further magnify the velocity of the downward foot motion of the drummer, thereby further magnifying the velocity of the mallet as the mallet strikes the drum.

It is also an object of the invention to use whenever possible the present components of standard foot activated musical drum pedal devices.

It is a further object of the invention to incorporate a pulley or sprocket wheel assembly at the toe end of the foot pedal by attaching a flexible member to the crossarm lever and passing it down and around the toe end wheel, and then upwardly to a point of attachment, either on the crossarm lever again, or on a second crossbar.

These and other objects of the invention which will become apparent from the following specification are accomplished by means hereafter described and claimed.

The present invention is embodied in a foot activated musical drum pedal wherein the downward motion of a foot pedal is translated into a forward motion of a mallet head striking toward a drum surface. The drum pedal includes a base and foot pedal, and a mallet head on a handle attached to a crossarm. The crossarm is mounted on bearings, which are in turn supported by a pair of uprights arising from the base such that forward rotation of the crossarm rotates the mallet head forwardly of the base. The toe end of the foot pedal is positioned generally between the uprights and generally below the crossarm.

The drum pedal invention also includes a flexible member connected at one end to a curved lever and wrapped over an upper portion of the curved lever. This flexible member and curved lever combination may be a chain and sprocket or a cord and pulley, or a strap and drum, or the like. The curved lever is fastened to the crossarm so that a torque exerted on the curved lever results in rotation of the crossarm in its bearings. Where pulleys or sprockets are employed, a central plane of the pulley or sprocket is generally normal to the axis of the crossarm. Where a drum is employed, the axis of the drum is generally parallel, or congruent with, the axis of the crossarm.

The invention is further characterized in that it comprises a wheel mounted in the toe end of the foot pedal for rotation about an axis which is substantially parallel to the axis of the crossarm. This wheel may be a sprocket wheel, a pulley wheel, or a drum. The wheel is housed within a wheel assembly which is either attached to the toe end of the foot pedal, or which is integral to the toe end of the foot pedal. The flexible member which is attached to one end to the curved lever and wrapped over an upper portion of the curved lever is then directed downwardly and around and under the wheel at the toe end of the foot pedal and then upwardly for attachment to a mounting point which is connected to the base. The flexible member may either be wrapped along the front of the toe wheel, under, and then upwardly along a rear portion of the wheel; or it may be wrapped from along the rear, under, and then upwardly along a forward portion of the wheel. The mounting point may be connected to the base in any of several manners: it can be as simple as a horizontal bar attached to, and across, the two uprights at a point generally above the toe end of the foot pedal in its uppermost rest position, and below the crossarm; it can also be a bar projecting laterally from a single upright; or a third upright arising from the base generally forwardly of the forward end of the toe wheel assembly. This latter embodiment is particularly useful for when the flexible member is initially wrapped rearwardly of the toe wheel.

In a preferred embodiment, the curved lever is a portion of a curved sprocket wheel, it is necessary only to have a sufficient segment of the curved sprocket to present enough sprocket teeth for engagement of a conventional sprocket chain such that movement of the foot pedal through its full range of up/down motion still leaves at least one chain pin engaged between two of the sprocket teeth. The sprocket may be generally circular, or cam shaped, and may be either mounted concentric or eccentric to the axis of the crossarm.

In another embodiment, a lever, with a forward portion extending generally farther from the crossarm than does a rearward portion of the lever, is attached to the crossarm to translate a rotational torque upon the lever to a rotation of the crossarm. This embodiment also includes a pulley wheel assembly fixed to the toe end of the pedal and generally under the lever means.

In a preferred variation of this embodiment, the lever means can be a nonconcentrically mounted curved lever with an upper indenture or groove. A flexible member, for example a multifilament cord such as nylon or similar material, is fixed to the rear portion of the lever means; that is, a portion of the lever means fixed rearwardly of the crossarm. The cord is laced forward, above and over the lever means, downward to and then around the pulley wheel rearwardly on the toe end of the pedal and upwards to attach to the rear portion of the lever means.

The pulley or sprocket wheel attached to the toe end of the pedal and linked as disclosed above to the crossarm provides an improved mechanical advantage to the device, thereby increasing the length of arc of travel of the mallet head with respect to the length of arc of the foot pedal, when compared to the prior art devices which attach the lever directly to the toe end of the pedal.

Thus a downward rotational movement of the foot pedal rotates the crossarm and the mallet in a manner that is faster than if the flexible mender were simply fixed between the lever and the toe end of the pedal.

BEST MODE OF CARRYING OUT OF THE INVENTION

Figure 1:
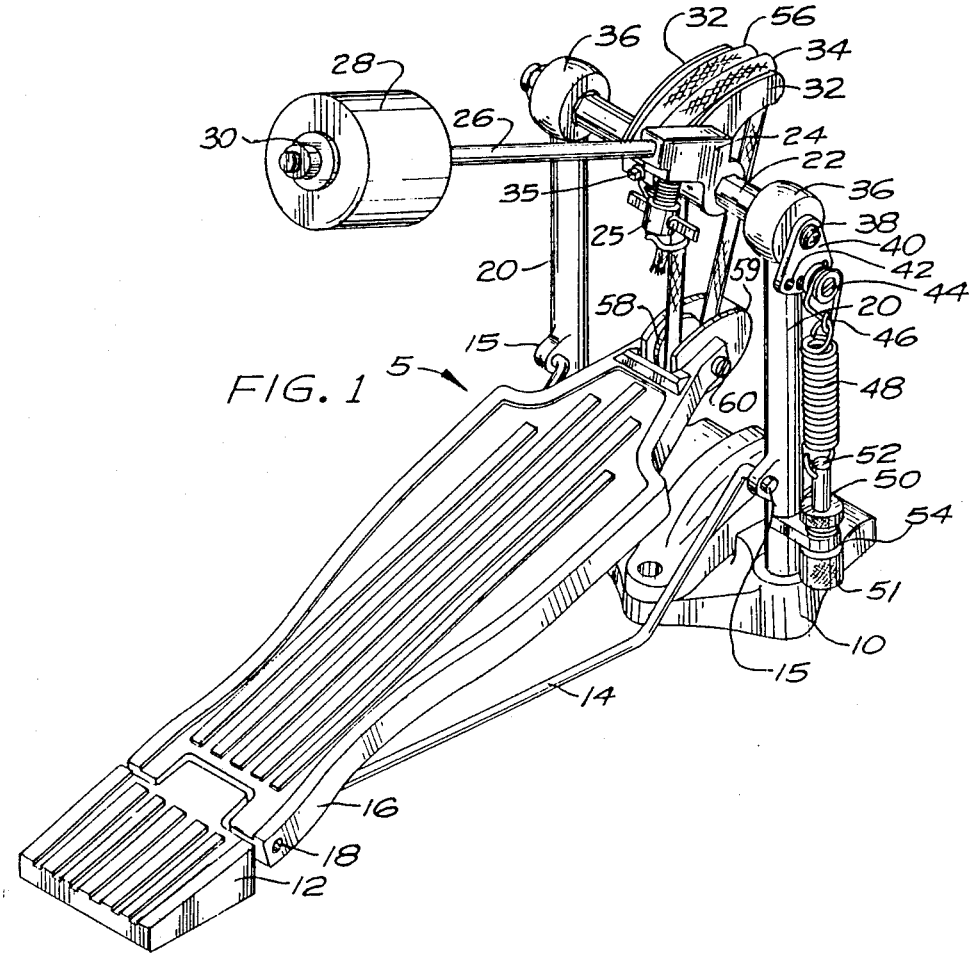
FIG. 1 is a perspective view of one embodiment of an improved foot activated musical drum pedal.

Referring to FIG. 1, drum pedal 5 comprises a forward base 10 and a rearward base 12 interrelated by a connecting member 14 A foot pedal 16 attaches to the rearward base 12 by a hinge pin 18 to permit an up/-down rotation of the toe end of foot pedal 16 about the axis of pin 18. Arising from the forward base 10 are two uprights 20. The connecting member 14 attaches to a mid portion 15 of the vertical supports. A hexagonal crossarm 22 spans the uprights 20. A mallet base 24 with a matching hexagonal channel attaches to a midsection of hexagonal crossarm 22, and can be locked thereto with a set screw (not shown). A mallet handle 26 fits into a recess in the mallet base 24 and is locked by thumbscrew 25. A mallet head of soft material 28 is fixed to the end of the mallet handle 26 with a mallet head nut 30. Also attached to the midsection of the hexagonal crossarm 22 is a curved lever 32 which has upper pulley grooves 34 and is fixed to the hexagonal crossarm 22 by a set screw 35. Lever 32 has a curvature which is nonconcentric with crossbar 22, such that a forward portion if the lever extends generally upwards and forwards of crossbar 22, and a rearward portion extends generally upwards and rearwards of crossbar 22, with the forward portion extending generally farther from the crossarm than the rearward portion. The crossarm is attached to the upper parts of uprights 20 with ball bearing swivels 36. With this arrangement a rotational movement of the crossarm 22 swings the mallet head 28.

A bias lever 40 is attached to one end of the crossarm 22 with a screw 38. The bias lever has several recesses 42 through which a set pin 44 holding a spring linkage 46 and spring 48 may be attached. The various recesses 42 provide the device with a means to adjust the stationary poise, or rest position, of mallet head 28. The other end of the spring 48 attaches through a passage 52 of an adjustable threaded bolt 50 with knurled adjustment head 51. The adjustable threaded bolt 50 attaches through an offset 54 near the base of one of the uprights 20. Adjustment head 51 permits adjustment of the spring tension for returning mallet head 28 to its rest position.

A pulley wheel 58 is attached within a pulley block assembly 59 to the toe end of the foot pedal 16 using a screw bolt 60. A flexible member 56 comprised of nylon braiding or other equivalent cordage is wrapped, with one end of the flexible member attached to a rearward part of the curved lever 32, over the curved lever through the pulley grooves 34, then downwardly and around the pulley wheel 58, and then upwardly to be attached at the other end of the flexible member to another rearward part of the curved lever 32. With this arrangement, a downward rotational movement of the toe end of the foot pedal 16 translates into a forward rotation of the hexagonal crossarm 22, mallet handle 26, and mallet head 28. However, the pulley arrangement at the toe end of the foot pedal 16 offers a different mechanical advantage over the prior art so that a downward rotational movement of the toe end of the foot pedal 16 through a given arc segment causes a forward rotational motion of the mallet head 28 through an arc segment which is twice as great as the arc segment of motion of foot pedal 16. Since mallet head 28 travels through twice the arc of foot pedal 16, it follows that mallet head 28 has twice the average velocity of foot pedal 16, thereby greatly improving the quality of the resulting sound and decreasing the required foot pedal travel for producing a given mallet velocity.

In another embodiment of the invention, the curved lever 32 with pulley grooves 34, and the pulley wheel 58 with assembly 59 are replaced by a curved sprocket lever and sprocket wheel interrelated by a chain drive linkage member to produce the same effect. The chain can either be attached to the curved sprocket lever in a manner similar to that shown in FIG. 1, or the ends of the chain may be attached together to form a chain belt.

In either of the embodiments described just above, rotation of crossarm 22 and curved lever 32 occurs as foot pedal 16 is depressed even though the two ends of flexible member 56 are functionally joined together to from a closed loop around curved lever 32 and pulley wheel 58. This results from the nonconcentric positioning of the curvature of lever 32 with a respect to crossarm 22. That is, a downward elongation of the loop formed by flexible member 56 will always cause a moment of torque upon lever 32 around crossarm 22 because lever 32 is thus eccentrically positioned.

Figure 2:
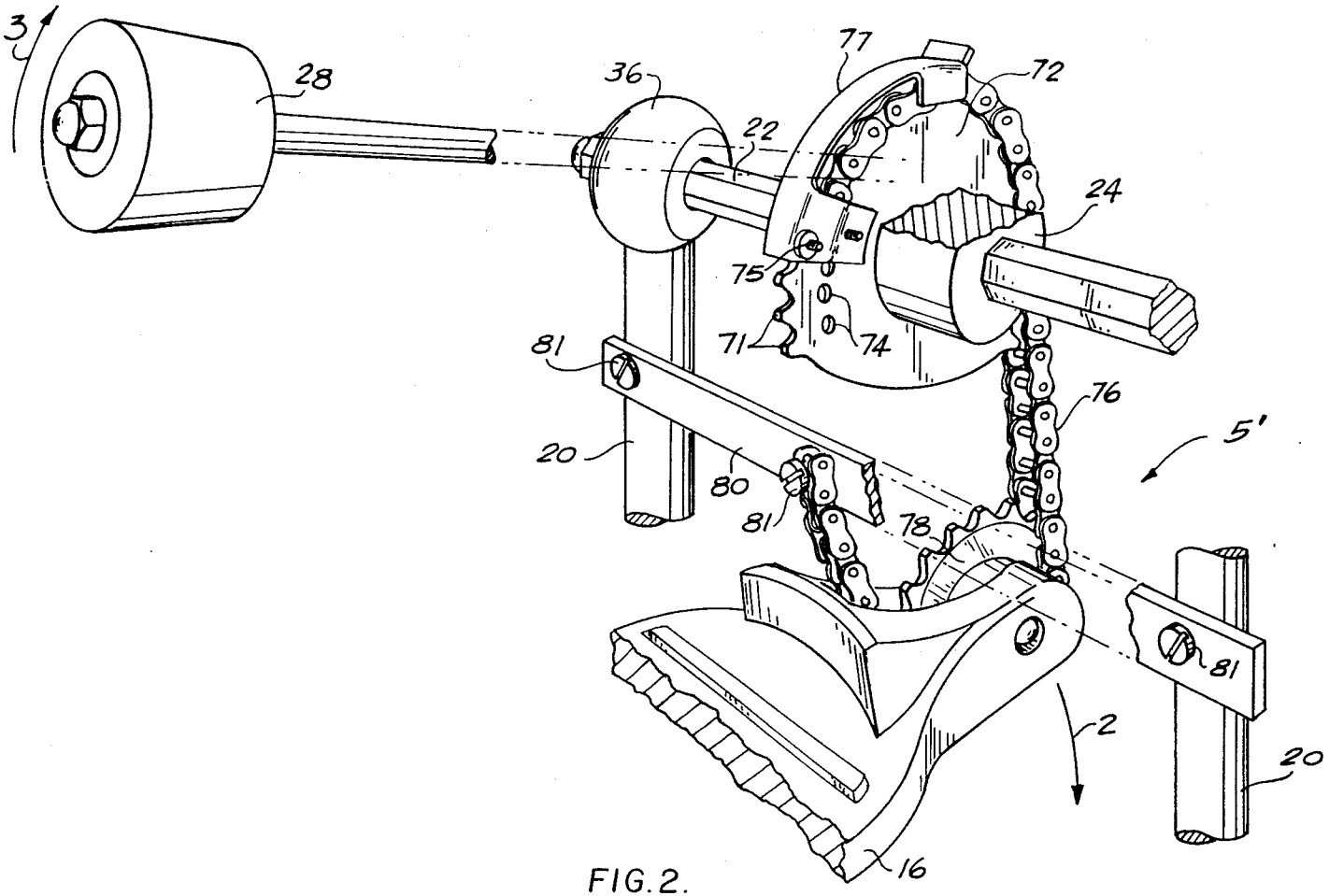
FIG. 2 is a partial perspective view of a preferred embodiment of the invention illustrating only the differences between this embodiment and that shown in FIG. 1.
Figure 3:
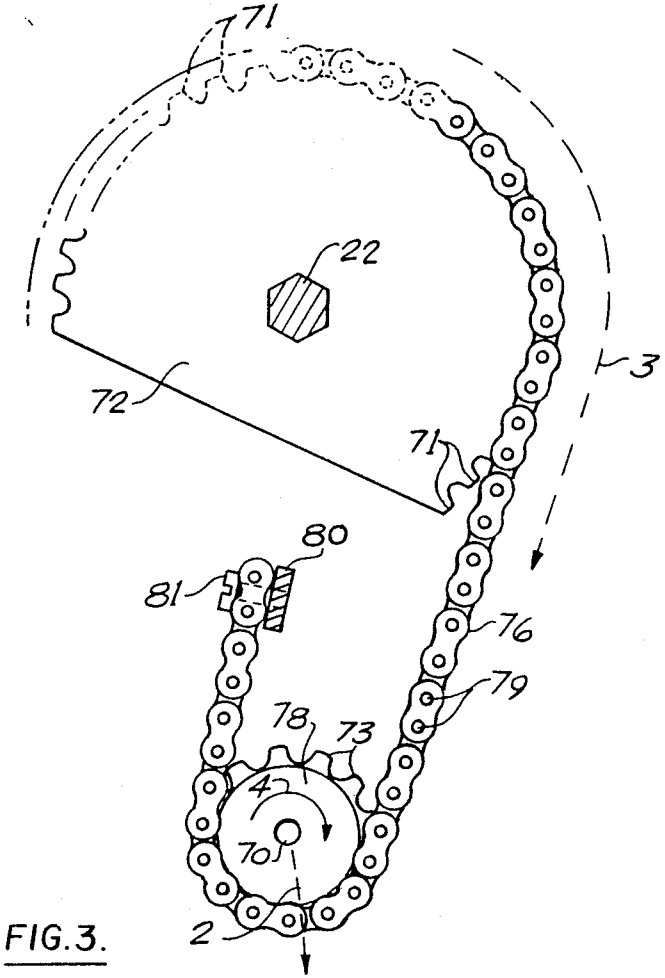
FIG. 3 is a schematic, generally side elevational, representation of the sprocket, chain, and wheel illustrated in FIG. 2.

Referring to FIGS. 2 and 3, a preferred embodiment of the invention is described which is a variation on the embodiment disclosed with respect to FIG. 1. For ease of illustration, FIG. 2 shows only those parts of the apparatus which differ from that illustrated in FIG. 1, with the exception that mallet head 28 is also shown to assist in visual continuity between FIGS. 1 and 2. Parts of the apparatus not described with reference to FIGS. 2 and 3 may be assumed to function exactly as described with respect to FIG. 1.

In this embodiment, a sprocket wheel 78 is mounted for rotation about a shaft 70 at the toe end of the foot pedal 16. Sprocket wheel 78 is comprised of a plurality of sprocket wheel teeth 73. A generally circular sprocket 72, with the bottom portion of the circle truncated is mounted on crossarm 22 so that a rotational torque applied to sprocket 72 results in rotation of crossarm 22. Sprocket 72 is comprised of a plurality of sprocket teeth 71. This is accomplished in a conventional manner in a preferred embodiment by having crossarm 22 hexagonal in cross-section, and having a corresponding hexagonal aperture in the center of sprocket 72. In a preferred embodiment, sprocket 72 is attached with fasteners (not shown) to mallet base 24. It will be appreciated by those skilled in the art that sprocket 72 may, as well, be a full circular sprocket, and need not be truncated at its bottom portion; it will also be appreciated that the curvature of sprocket 72 serves the same function as curved lever 32 in FIG. 1, and that the curvature of sprocket 72 need not necessarily be circular. For instance sprocket 72 may be a eccentric cam. It will also be appreciated that sprocket 72 need not be concentrically mounted on crossarm 22 but may, as well, be eccentrically mounted. A cam shape to sprocket 72 and/or eccentric mounting of sprocket 72 upon crossarm 22 will result in variance of the mechanical advantage of the overall compound leverage system of the invention without departing from the scope of the invention. It is contemplated that a curved lever such as curved lever 32 in FIG. 1, or a pulley, or a drum may also be substituted for sprocket 72.

Sprocket chain 76 serves as the flexible member of the invention and is comprised in conventional fashion of a series of chain pins 79 held together by the links of chain 76. The pitches of sprocket teeth 71, sprocket wheel teeth 73, and chain pins 79 are compatible with one another, and are preferably substantially identical to one another. Chain 76 may be fixed in any well known conventional manner to sprocket 72, such as by adjustable attachment to sprocket 72 by means of a sprocket retainer 77, screw 75 and adjustment apertures 74, or the like arrangement. In preferred embodiments, chain 76 is attached to an upper and rearward portion of sprocket 72 and wrapped over the upper portion of sprocket 72, downwardly around a frontward portion of sprocket wheel 78, under, and then upwardly to mounting bar 80, where chain 76 is fastened to mounting bar 80 by screw 81. Mounting bar 80 may be any suitably rigid strap material, such as a length of $\frac{1}{8}''$ by $\frac{1}{2}''$ cold rolled steel bar stock, which is fastened across and between uprights 20 with screws 81. Chain 76 is attached to mounting bar 80 generally in its center.

It will be appreciated that other flexible members may be substituted for chain 76 where substitutions are also made for sprocket 72. For instance, any flexible cordage may be used where a pulley is substituted for sprocket 72, and any flexible strap material may be used where a drum is substituted for sprocket 72. Similarly, other wheels may be substituted for sprocket wheel 78 which are compatible with the pulley or drum type substitutions of sprocket 72 and its corresponding flexible member. The wrap of the flexible member, as is by example illustrated in the wrap of chain 76 around sprocket 72, or its substitute, and sprocket wheel 78, or its substitute, may either be generally a forward wrap as illustrated in FIG. 3, or a reverse wrap (not illustrated) wherein chain 76 is brought around the upper curvature of sprocket 72 and then rearwardly around sprocket 78, under, and then upwardly to an alternative mounting point other than mounting bar 80.

The arrangement of sprocket 72, sprocket wheel 78, and chain 76 just described comprises the elements of a basic compound pulley system according to the principles of simple mechanics. Thus, since one end of chain 76 (the flexible member) is fixed at mounting bar 80, movement of foot pedal 16 along downward arc 2 produces a rotation of sprocket wheel 78 about shaft 70 in direction of rotation 4, causing in turn a serial displacement of sprocket teeth 73 from the rearwardly illustrated portion of chain 76, immediately below mounting bar 80, and a corresponding serial engagement of sprocket teeth 73 with the forwardly illustrated portion of chain 76. Since the rearward portion of the chain is stationary in its mounting to bar 80, the forward portion of the chain necessarily moves downwardly. For every sprocket wheel tooth 73 which disengages the rearward portion of the chain, and has a corresponding sprocket wheel tooth 73 engage a forward portion of the chain 76, chain 76 moves downwardly by two chain pins 79. That is, a movement of sprocket wheel 78 along the direction of downward foot pedal arc 2 causes a downward movement of chain 76 along arc 3 which is twice as great as the movement of foot pedal along arc 2. Thus, chain 76 disengages itself from twice as many sprocket teeth 71 on sprocket 72 as it does from sprocket teeth 73 along the rearward portion of chain 76. Therefore for a given length of foot pedal travel along arc 2 the amount of rotational arc 3 produced at sprocket 72 and at mallet head 28 along arc 3 is twice as great. This mechanical description is of course not restricted to sprocket and chain systems, but applies as well to any system generally having a curved lever, a flexible member, and a wheel, where the flexible member is attached at one end to the curved lever and at the other end to some fixed point between the wheel and the curved lever.

It has been found that the apparatus illustrated in FIGS. 2 and 3 may best be made by modifying an existing apparatus made according to U.S. Pat. No. 3,797,356, and currently available under the trademark CAMCO from the Tama drum company through it's dealers throughout the United States. This CAMCO brand drum pedal is best modified to accomplish the invention as disclosed above by modifying the toe end of the foot pedal as shown in FIG. 2 by first cutting a longitudinal slot to receive the sprocket wheel 78 and then heliarc welding additional stock to the toe end for reinforcement at the bearing of sprocket wheel 78 so that sprocket wheel 78 may be mounted on a shaft 70 for rotation therein. It is contemplated that production models will simply replace the foot pedal from the CAMCO brand drum pedal with a specially cast foot pedal as shown in FIG. 2. The chain on the CAMCO brand drum pedal is then replaced with a longer length of the same chain so that instead of fixing the chain to the end of the pedal as does Tama, the chain can be wrapped around sprocket wheel 78 and brought upwardly and fixed upon mounting bar 80. Of course, other embodiments and methods of construction of the apparatus of the invention will not depart from the scope of the invention merely because the apparatus is fashioned from other components, rather than from a modification of an existing drum pedal.

Figure 4:
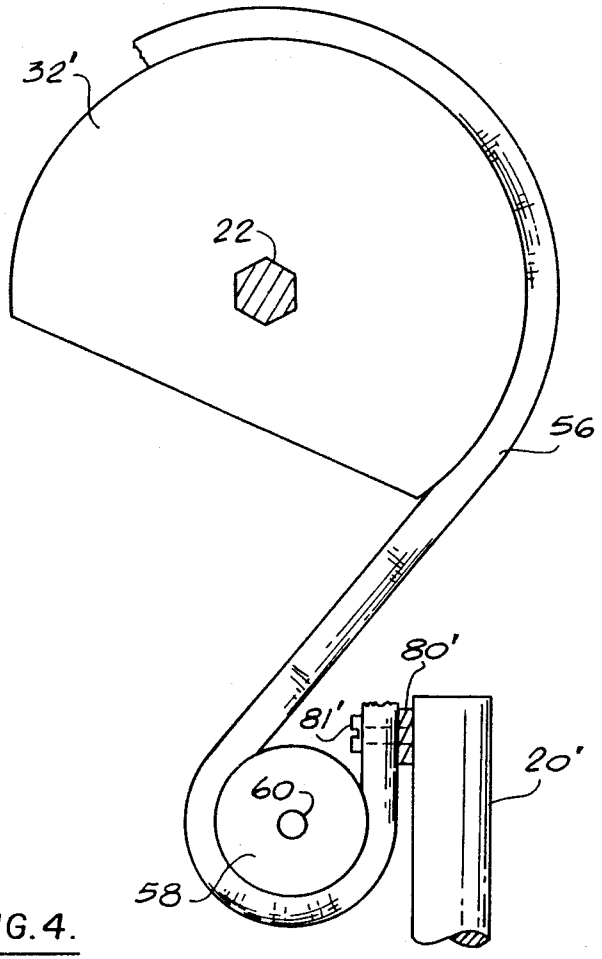
FIG. 4 is a schematic, generally side elevational representation of an alternate arrangement of the invention shown in FIG. 3.

Referring to FIG. 4, a number of alternative arrangements to those disclosed in FIGS. 1–3 are described. Instead of sprocket 72 in FIG. 3, a curve lever 32′ may be mounted upon crossarm 22. Curved lever 32′ may be a curved lever such as is illustrated by curved lever 32 in FIG. 1, or may be a circular or cam shape pulley which may be either complete or truncated. Flexible member 56′ corresponds to flexible member 56 in FIG. 1 and chain 76 in FIG. 3, and may be reverse wrapped as illustrated in FIG. 4 as an alternative to the forward wrap illustrated in FIG. 3. By way of example, FIG. 4 illustrates the use of a pulley wheel 58 mounted upon bolt 60 as illustrated in FIG. 1. Flexible member 56′ is fixed to an alternative mounting point 80′ by fastener 81′ which is connected to base (not shown) by an alternative upright 20′ Curved lever 32′ is shown in this illustration as being eccentrically mounted upon crossarm 22 for additional mechanical advantage of the compound lever system of the invention.

In compliance with the statute, the invention has been described in language more or less specific as to structural features. It is to be understood, however, that the invention is not limited to the specific features shown, since the means and construction shown comprise preferred forms of putting the invention into effect. The invention is, therefore, claimed in any of its forms or modifications with the legitimate and valid scope of the appended claims, appropriately interpreted in accordance with the doctrine of equivalents.

INDUSTRIAL APPLICABILITY

The invention will find use in the musical instrument industry, particularly in the acoustic and electronic drum industry. The invention represents a significant improvement in control and production of base drum notes, wherever a base drum is employed as a musical instrument. As compared to comparable conventional drum systems, the mallet head velocity in the invention is twice as great. This results in the production of bass drum note which can have sharper attacks, crisper sound, and greatly expanded dynamic range. At the same time, for a given mallet head velocity as it strikes the drum head, only half the foot pedal travel is required as compared to conventional drum pedal systems. Thus for example, rapid note series may be more easily controlled and produced without sacrificing dynamic range. The invention may be readily manufactured as a modification of existing conventional drum pedal systems.

I claim:

1. A drum pedal having a foot pedal pivotally mounted to a base, a mallet head and handle attached to a crossarm mounted for rotation about an axis within a pair of bearings supported upon a pair of uprights arising from said base, such that a toe end of said foot pedal lies generally between said uprights and below said crossarm, and a flexible member connected at one end to a curved lever attached to said crossarm, said drum pedal comprising;

a wheel mounted in said toe end for rotation about an axis substantially parallel to the axis of said crossarm;

wherein said flexible member is further wrapped from said curved lever, under said wheel, and then upwardly for attachment to a mounting point connected to said base.

2. The apparatus of claim 1 wherein said curved lever is a pulley, and said wheel is a pulley wheel.

3. The apparatus of claim 1 wherein said curved lever is a sprocket, said flexible member is a chain, and said wheel is a sprocket wheel.

4. The apparatus of claim 3 wherein said sprocket is concentrically mounted upon said crossarm.

5. The apparatus of claim 4 wherein said chain is wrapped over a portion of said sprocket, then downwardly and around a forward part of said sprocket wheel, under said sprocket wheel, and upwardly for attachment to said mounting point.

6. The apparatus of claim 5 wherein said mounting point is comprised of a horizontal bar connected to said pair of uprights.

7. The apparatus of claim 4 wherein said chain is wrapped over a portion of said sprocket, then downwardly and around a rearward portion of said sprocket wheel, under said sprocket wheel, and upwardly to said mounting point.

8. The apparatus of claim 7 wherein said mounting point is comprised of a third upright arising from said base at a point generally between and forward of said pair of uprights.

9. The apparatus of claim 1 wherein said curved lever has a forward portion which extends generally forwardly and upwardly from said crossarm, and a rearward portion which extends generally rearwardly and upwardly from said crossarm, said forward portion extending generally farther from said crossarm then said rearward portion.

* * * * *